US008572910B2

(12) United States Patent
Hendricks

(10) Patent No.: US 8,572,910 B2
(45) **Date of Patent: *Nov. 5, 2013**

(54) CAP-ON-CAP MOUNTING BLOCK

(75) Inventor: Robert Hendricks, Youngstown, OH (US)

(73) Assignee: Tapco International, Inc., Wixom, MI (US)

( * ) Notice: Subject to any disclaimer, the term of this patent is extended or adjusted under 35 U.S.C. 154(b) by 2014 days.

This patent is subject to a terminal disclaimer.

(21) Appl. No.: 11/482,521

(22) Filed: Jul. 7, 2006

(65) Prior Publication Data

US 2007/0033888 A1 Feb. 15, 2007

Related U.S. Application Data

(63) Continuation-in-part of application No. 10/435,258, filed on May 9, 2003, now Pat. No. 7,510,153.

(51) Int. Cl.
*E04B 7/00* (2006.01)

(52) U.S. Cl.
USPC ..... 52/198; 220/3.8; 220/4.02; 174/50; 174/562

(58) Field of Classification Search
USPC ..... 248/342, 317, 220.21, 220.22, 226.11, 248/231.9, 222.41, 224.8; 174/50, 53, 58; 220/3.2, 3.3, 3.8, 3.9; 52/198, 220.8, 52/220.1
See application file for complete search history.

(56) References Cited

U.S. PATENT DOCUMENTS

| | | | | |
|---|---|---|---|---|
| 625,756 | A | 5/1899 | Glover | |
| 685,615 | A | 10/1901 | King | |
| 1,484,001 | A | 2/1924 | Ainsworth | |
| 2,202,147 | A | 5/1940 | Gerriets | 277/305 |
| 2,494,428 | A | 1/1950 | Buck | 98/121 |
| 2,752,844 | A | 7/1956 | Simblest | 98/121 |
| 2,780,128 | A | 2/1957 | Rapata | 85/5 |
| 2,927,497 | A | 3/1960 | Rapata | 85/5 |
| 3,103,710 | A | 9/1963 | Fredricksen | 20/11 |
| 3,139,784 | A | 7/1964 | Moorman | 85/5 |
| 3,315,924 | A | 4/1967 | Greenwood | 248/27 |
| 3,365,156 | A | 1/1968 | Beck | 248/205 |
| 3,386,606 | A | 6/1968 | Pastrick | 220/3.94 |
| 3,455,079 | A | 7/1969 | Frederick | 52/473 |
| 3,494,244 | A | 2/1970 | Wayland | 85/5 |
| 3,500,600 | A | 3/1970 | Bagley, Sr. | 52/211 |
| 3,584,427 | A | 6/1971 | Johnston | 52/473 |
| 3,810,279 | A | 5/1974 | Swick et al. | 24/73 P |
| 3,906,145 | A | 9/1975 | Carmichael | 174/61 |
| 3,977,137 | A | 8/1976 | Patry | 52/60 |
| 4,012,580 | A | 3/1977 | Arnold | 174/53 |

(Continued)

FOREIGN PATENT DOCUMENTS

| | | | |
|---|---|---|---|
| CH | 568497 | 8/1977 | |
| DE | 2406231 | 8/1974 | F16B 15/06 |
| FR | 2 334 869 | 7/1977 | F16B 15/02 |
| GB | 2149494 A | 6/1985 | F24F 7/04 |

*Primary Examiner* — Todd M. Epps

(74) *Attorney, Agent, or Firm* — Quinn Law Group, PLLC

(57) ABSTRACT

A wall-mounting block or frame is used to mount fixtures to exterior building walls having siding. The wall-mounting block includes two major parts, a first or base section and a second or holding section which are both configured as cap-like structures detachably connected to each other with integrated, adjustable connectors. The present design eliminates the need for special hardware to attach the holding section to the base section, and helps prevent awkward mounting situations.

12 Claims, 4 Drawing Sheets

(56) References Cited

U.S. PATENT DOCUMENTS

| | | | | |
|---|---|---|---|---|
| 4,082,915 | A | 4/1978 | Silver | 174/51 |
| 4,134,636 | A | 1/1979 | Kleinatland et al. | 439/535 |
| 4,142,155 | A | 2/1979 | Adachi | 375/260 |
| 4,156,272 | A | 5/1979 | Wandler | 362/432 |
| 4,229,916 | A | 10/1980 | White | 52/98 |
| 4,245,284 | A | 1/1981 | Moore et al. | 362/311 |
| 4,287,657 | A | 9/1981 | Andre et al. | 29/450 |
| 4,327,841 | A | 5/1982 | Wimberly | 220/477 |
| 4,389,824 | A | 6/1983 | Anderson | 52/211 |
| 4,407,100 | A | 10/1983 | Huelsekopf | 52/212 |
| 4,472,768 | A | 9/1984 | Quiogue | 362/370 |
| 4,635,168 | A | 1/1987 | Crowley | 562/147 |
| 4,726,152 | A | 2/1988 | Vagedes et al. | 52/28 |
| 4,794,207 | A | 12/1988 | Norberg et al. | 174/505 |
| 4,854,093 | A | 8/1989 | Kellom | 52/28 |
| 4,874,904 | A | 10/1989 | Desanti | 174/53 |
| 4,875,318 | A | 10/1989 | MacLeod et al. | 52/211 |
| 4,920,708 | A | 5/1990 | MacLeod et al. | 52/60 |
| 4,922,056 | A | 5/1990 | Larson | 174/663 |
| 4,922,673 | A * | 5/1990 | Ishii et al. | 52/220.1 |
| 5,000,409 | A | 3/1991 | MacLeod et al. | 248/205.1 |
| 5,042,673 | A | 8/1991 | McShane | 220/3.7 |
| 5,084,596 | A | 1/1992 | Borsh et al. | 174/53 |
| 5,117,996 | A | 6/1992 | McShane | 220/3.7 |
| 5,133,165 | A | 7/1992 | Wimberly | 52/220.8 |
| 5,223,673 | A | 6/1993 | Mason | 174/53 |
| 5,245,804 | A | 9/1993 | Schiedegger et al. | 52/199 |
| D343,825 | S | 2/1994 | Enderby | D13/152 |
| 5,287,665 | A | 2/1994 | Rath, Jr. | 52/220.8 |
| 5,326,060 | A | 7/1994 | Chubb et al. | 248/231.9 |
| 5,349,799 | A | 9/1994 | Schiedegger et al. | 52/473 |
| 5,365,707 | A | 11/1994 | Jones et al. | 52/211 |
| 5,397,093 | A | 3/1995 | Chubb et al. | 248/544 |
| 5,401,903 | A | 3/1995 | Logan | 174/66 |
| 5,471,803 | A | 12/1995 | Logan et al. | 52/212 |
| 5,478,032 | A | 12/1995 | Miller | 248/27.1 |
| 5,487,701 | A | 1/1996 | Schiedegger et al. | 454/271 |
| 5,491,936 | A | 2/1996 | Logan et al. | 52/105 |
| 5,522,577 | A | 6/1996 | Roesch | 248/343 |
| 5,535,558 | A | 7/1996 | Rieke et al. | 52/199 |
| 5,549,266 | A | 8/1996 | Mitchell et al. | 248/205.1 |
| 5,577,702 | A | 11/1996 | Chubb et al. | 248/544 |
| 5,578,791 | A | 11/1996 | Bosse, Jr. | 174/481 |
| 5,596,852 | A | 1/1997 | Schiedegger | 52/212 |
| 5,598,670 | A | 2/1997 | Humphrey et al. | 52/220.8 |
| 5,659,151 | A | 8/1997 | Dale | 174/666 |
| 5,668,350 | A | 9/1997 | Yanase | 174/50 |
| D391,648 | S | 3/1998 | Sølbeck | D25/60 |
| 5,722,208 | A * | 3/1998 | Humphrey et al. | 52/220.8 |
| 5,729,935 | A | 3/1998 | Schiedegger et al. | 52/198 |
| 5,773,757 | A | 6/1998 | Kenney et al. | 174/53 |
| 5,775,032 | A | 7/1998 | Lacy | 52/28 |
| 5,791,985 | A | 8/1998 | Schiedegger et al. | 454/339 |
| 5,804,764 | A | 9/1998 | Gretz | 174/53 |
| 5,831,212 | A | 11/1998 | Whitehead et al. | 174/50 |
| 5,918,431 | A | 7/1999 | Schiedegger et al. | 52/220.01 |
| 5,920,033 | A | 7/1999 | Bosse, Jr. | 174/481 |
| 5,947,816 | A | 9/1999 | Schiedegger et al. | 454/339 |
| 5,952,610 | A | 9/1999 | Bosse, Jr. | 174/481 |
| 5,957,414 | A | 9/1999 | Perrignon de Troyes | 248/27.1 |
| 6,005,188 | A | 12/1999 | Teichler et al. | 174/50 |
| 6,041,956 | A | 3/2000 | Kao | 220/4.03 |
| D422,266 | S | 4/2000 | Roesch | D13/152 |
| 6,051,786 | A | 4/2000 | Gretz | 174/57 |
| 6,107,567 | A | 8/2000 | Blalock | 174/58 |
| 6,112,927 | A | 9/2000 | Gretz | 220/3.7 |
| 6,126,296 | A | 10/2000 | Justiniano et al. | 362/147 |
| 6,133,524 | A | 10/2000 | Bosse, Jr. | 174/481 |
| 6,196,915 | B1 | 3/2001 | Schiedegger et al. | 454/339 |
| 6,208,503 | B1 | 3/2001 | Shimada et al. | 361/523 |
| 6,239,368 | B1 | 5/2001 | Gretz | 174/57 |
| 6,268,563 | B1 | 7/2001 | Gretz | 174/53 |
| 6,303,858 | B1 | 10/2001 | Bosse, Jr. | 174/500 |
| 6,310,287 | B1 | 10/2001 | Schiedegger et al. | 174/50 |
| 6,355,882 | B1 | 3/2002 | Gretz | 174/53 |
| 6,358,882 | B1 | 3/2002 | Salem et al. | 502/305 |
| 6,359,220 | B2 * | 3/2002 | Schiedegger et al. | 174/50 |
| 6,383,072 | B2 | 5/2002 | Schiedegger et al. | 454/339 |
| 6,386,972 | B1 | 5/2002 | Schiedegger et al. | 454/358 |
| 6,417,447 | B1 | 7/2002 | Bosse, Jr. | 174/505 |
| 6,429,371 | B2 | 8/2002 | Schiedegger et al. | 174/50 |
| 6,600,117 | B1 | 7/2003 | Gretz | 200/294 |
| 6,717,050 | B2 * | 4/2004 | Laflamme et al. | 174/50 |
| 6,723,921 | B2 | 4/2004 | Vagedes | 174/58 |
| 6,751,915 | B2 | 6/2004 | Crowley | 52/311.2 |
| 6,774,304 | B1 | 8/2004 | Gretz | 174/50 |
| 6,780,100 | B1 | 8/2004 | Gretz | 454/359 |
| 6,825,414 | B2 | 11/2004 | Vagedes | 174/58 |
| 6,956,171 | B1 | 10/2005 | Gretz | 174/58 |
| RE38,881 | E | 11/2005 | Chubb et al. | 248/231.9 |
| 6,965,078 | B1 | 11/2005 | Gretz | 174/58 |
| 7,005,578 | B2 | 2/2006 | Gretz | 174/58 |
| 7,064,271 | B1 | 6/2006 | Gretz | 174/58 |
| 7,115,820 | B1 | 10/2006 | Gretz | 174/481 |
| 7,117,591 | B1 | 10/2006 | Gretz | 29/854 |
| 7,410,072 | B2 * | 8/2008 | Wegner et al. | 220/3.7 |
| 7,510,153 | B2 * | 3/2009 | Hendricks | 248/231.9 |
| 8,152,013 | B2 * | 4/2012 | Hendricks | 220/3.8 |
| 2005/0055920 | A1 | 3/2005 | Lajewski | 52/302.1 |
| 2008/0168722 | A1 * | 7/2008 | Hendricks | 52/198 |

* cited by examiner

CAP-ON-CAP MOUNTING BLOCK

RELATED APPLICATIONS

This is a: CONTINUATION-IN-PART based on U.S. Utility patent application Ser. No. 10/435,258, filed: May 9, 2003 now U.S. Pat No.7,510,153.

FIELD OF THE INVENTION

The present invention is generally related to frames, blocks, brackets, or other structures for mounting fixtures to a wall. More particularly, the present invention is directed to a wall-mounting block that is used to easily lock over the siding of an exterior wall on which the mounting block is used.

BACKGROUND ART

Standard frame construction is used in virtually all residential and related construction in the United States, and in many other places throughout the world. This method of construction includes a wooden or steel framework of studs covered with a light sheathing of foam, light fiberboard or plywood, Celotex™, or any number of other light sheathing or substrate materials. Normally, heavy-duty fiberboard or plywood is not used throughout a frame construction due to the cost. Further, it has been found far more desirable to use a light-weight sheathing material that has some insulating or even waterproofing value. In most external wall systems some type of siding material is applied over the sheathing to provide water resistance and decorative features.

Sometimes the sheathing or substrate is of wood, and has substantial structural value. In other cases, the sheathing can be low-gauge vinyl supported by a foam backing, to obtain improved insulating properties, but having little structural value. The same types of materials can also be used for the overlying siding. In many cases, neither the siding nor the underlying sheathing is separately capable of supporting a fixture to be mounted on the exterior wall. Consequently, standard frame construction very often requires that both the sheathing and the siding be used in conjunction to support any fixtures to be added to the wall. This is especially important when apertures must be formed in substrate and siding to accommodate a fixture, but which weakens the wall. If the substrate and siding can't support the fixture it must be moved so as to be supported by a stud, or a more substantial portion of the wall.

As a result, the building industry has adopted a number of mounting blocks that utilize the combined strength of both the siding and the underlying substrate or sheathing. Conventionally, this is done by having a lower mounting frame attached, around an aperture (accommodating the fixture to be mounted), and directly attached to the sheathing. A second or upper mounting frame is attached to the already fixed lower mounting frame fixed to the sheathing. Normally this second frame is used to constitute the support for the external fixture, and is firmly connected to the sidewalls extending from the lower frame already mounted on the sheathing. The second mounting frame derives a great deal of its strength by firmly interfacing with the perpendicular sidewalls or framework of the lower mounting frame. Finally, there is a holding piece (or pieces) which attaches either to the upper frame (fixture support) or the lower mounting frame (in some cases both), to hold the siding and to utilize the structural capability of the siding around the overall mounting block.

By placing a solid framework around the aperture in the wall, and firmly interlocking all three of the mounting frame pieces, a moderately stable mounting support for a fixture can be effected, even on a relatively flimsy wall.

However, using conventional mounting blocks, this process has not always been easy to carry out. In many traditional arrangements, three (or more) different pieces must be fit together, in addition to the fixture. Consequently, the process can be extremely awkward, especially if unskilled labor is employed, or adverse conditions ensue.

Another problem, even for highly skilled workers, is the fact that conventional mounting blocks normally come in three separate pieces, often with separate connecting devices for each piece. Under the often-chaotic conditions of construction sites, pieces of the mounting blocks, especially the connectors, can be misplaced or lost. This results in delays or other difficulties, and often leads to the expedient of ordering redundant mounting blocks just to make certain that a full kit is available when needed.

This problem has been addressed in part by arrangements in which two of the three components are temporarily attached together. However, there have been difficulties with such arrangements since sometimes the attached components must be separated for one to be mounted, and then reattached to each other. This often leads to breakage.

In some arrangements, two of the components (lower frame and fixture support structure) are formed as one piece, alleviating some of the aforementioned difficulties. However, the upper holding piece which is used to hold the surrounding siding, is usually a separate piece in conventional mounting block designs. Otherwise, it would be very difficult to position and connect the holding piece to the wall using conventional mounting blocks. Unfortunately, this upper holding piece can be lost. In some cases, even if the upper holding piece is not lost, its connectors can be, thereby compromising the overall mounting block.

This drawback has been addressed in U.S. patent application Ser. No. 10/435,258, (Patent Publication No. 2004-0221522-A1) filed May 9, 2003, by the same inventor and incorporated herein by reference. In this arrangement, the pieces used for holding the siding are attached to a cap-like structure support that is used to support the fixture and has mounting flanges to attach to the substrate or underlayment of the wall. This mounting block is used by cutting away the siding around the aperture through which the fixture will pass through the substrate of the wall. The holding structures are arranged as two rotate able pieces that are permanently attached to the rest of the mounting block. When the mounting block is put in place, the holding pieces rotate opposite each other over the surrounding siding. The subject mounting block is easy to handle and to install. The rotating holding pieces provide a convenient handle for shifting and positioning the entire mounting block. The rotating holding pieces can lock into place around the support structure of the mounting block. The permanent attachment keeps the holding pieces from being lost, or otherwise separated from the rest of the mounting block.

While the overall structure and operation of the aforementioned subject mounting block is generally superior in all respects, there are some disadvantages that have been discovered. Under normal, expected usage, the plastic hinges of the subject mounting block are not at risk. However, as is so often the case on a construction site, abuse can occur and the hinges can break. Likewise, the connections between the rotating holding pieces and the rest of the mounting block can also be broken, creating a separation that might be very difficult to repair. Even if repair is possible, there is the possibility of water working its way past the water tight seals of the mounting block and into the vulnerable, underlying wall.

There are other drawbacks to this design. For example, the plastic hinges can be warped by heat, like any plastic mounting block. Further, the rotation of the holding pieces does not permit an optimum fit for locking purposes, even though a wide range of siding thicknesses can be accommodated for this particular design. As with any plastic design, general warping of the overall structure of the mounting block may lead to the intrusion of water at various points through and around the mounting block. Also, as is the case at any construction site, less than precise measurements may lead to installation efforts for siding sizes that are either too great or too small to be accommodated by the mounting block. This would result in a questionable lock between the rotating holding pieces and the rest of the mounting block, compromising both the fixture and the surrounding siding.

Accordingly, there is a substantial need for an improved wall-mounting block that overcomes the difficulties of the conventional mounting blocks. In particular, such an improved mounting block would alleviate the problems of lost parts, and facilitate easy installation. Also, an improved mounting block would provide for varying thicknesses of siding and sheathing while maintaining substantial resistance to water intrusion.

SUMMARY OF THE INVENTION

Accordingly, it is one object of the present invention to overcome the deficiencies of the conventional art.

It is another object of the present invention to simplify the installation of fixtures on frame walls, and other structures in which an aperture is used to accommodate the fixture.

It is a further object of the present invention to provide a wall-mounting block that is easily adjustable for a wide range of wall and siding thicknesses.

It is an additional object of the present invention to provide a wall-mounting block which is configured to avoid the loss of critical parts.

It is still another object of the present invention to provide a wall-mounting block that is more easily installed than conventional mounting blocks.

It is yet a further object of the present invention to provide a wall-mounting block that has the capability of utilizing all structural aspects of a wall to maintain a secure support for a fixture.

It is again an additional object of the present invention to provide a wall-mounting block having integral parts to facilitate handling of the mounting block during the mounting process.

It is still another object of the present invention to provide a wall-mounting block that is formed to be extremely robust.

It is again a further object of the present invention to provide a mounting block for wall vents and gable vents of varying sizes and shapes.

It is yet an additional object of the present invention to provide a mounting block for a wide variety of fixture types.

It is still another object of the present invention to provide a wall mounting block capable of superior structural strength over that of conventional mounting blocks, so that heavier fixtures can be safely mounted that is possible with many conventional designs.

It is again a further object of the present invention to provide a mounting block that is more highly resistant to water intrusion than many conventional mounting blocks.

It is yet an additional object of the present invention to provide a mounting block capable of uniform, reliable locking or latching over a wide range of siding thicknesses.

It is still another object of the present invention to provide a wall mounting block more highly resistant to warping and misalignment than conventional mounting blocks.

These and other goals and objects of the present invention are achieved by a two section mounting block, arranged to hold a fixture to a wall having a substrate and siding arranged over that substrate. The first section is a base section having at least one integrally formed mounting flange arranged to be positioned against the substrate. The base section is formed as a cap-like support structure including side walls extending perpendicularly from the mounting flange to a contiguous integrally formed upper interface surface. The interface surface includes a plurality of integrally formed connector recesses. The second section is a holding section having integrally formed contiguous side walls supporting perpendicularly extending, integrally formed holding flanges, and an upper support surface to form a cap-like structure arranged to fit over the cap-like support structure, the base section. The upper support surface has downwardly extending connecting prongs corresponding to the plurality of connector recesses in the base section.

DETAILED DESCRIPTION OF THE PREFERRED EMBODIMENTS

The wall-mounting block 1 of the present invention is depicted in FIGS. 1-4, which all use the same drawing designation numerals for the various parts of the wall-mounting block. The wall-mounting block of the present invention is meant in a first preferred embodiment to be mounted around an aperture in a wooden frame wall of standard construction. However, the aperture is not necessary for the proper operation of the present invention. It is the fixture that dictates the characteristics of the aperture.

The strength of the wall-mounting block 1 of the present invention allows it to be particularly effective even on walls constituted by flimsy materials. The present invention facilitates use with (or without) an aperture in almost any type of structural material. This can include anything from plastic foam to steel. Preferably the wall structure will have some sort of siding to help facilitate the locking of the mounting frame to the wall, thereby making use of all the benefits of the present invention.

In all of its embodiments, the present invention is made of two self-contained sections 2, 3, with no other parts. Manufacturing can be done by injection or spin molding to form each section 2, 3. Both the upper holding section 2, and the lower or base section 3 are very similar to each other in both size and overall construction. Both share a cap-like configuration. Additional parts are not necessary since the connectors are self contained within each of the two sections.

In all embodiments of the present invention, the use of two self-contained pieces, provides many of the benefits of the present invention. In particular, crucial connecting parts cannot be lost since they are non-detachably formed as part of each sections 2, 3. This is a critical feature since at most construction sites, chaotic conditions ensue, and it is very common for parts from a box to become separated or lost.

Figure 1:
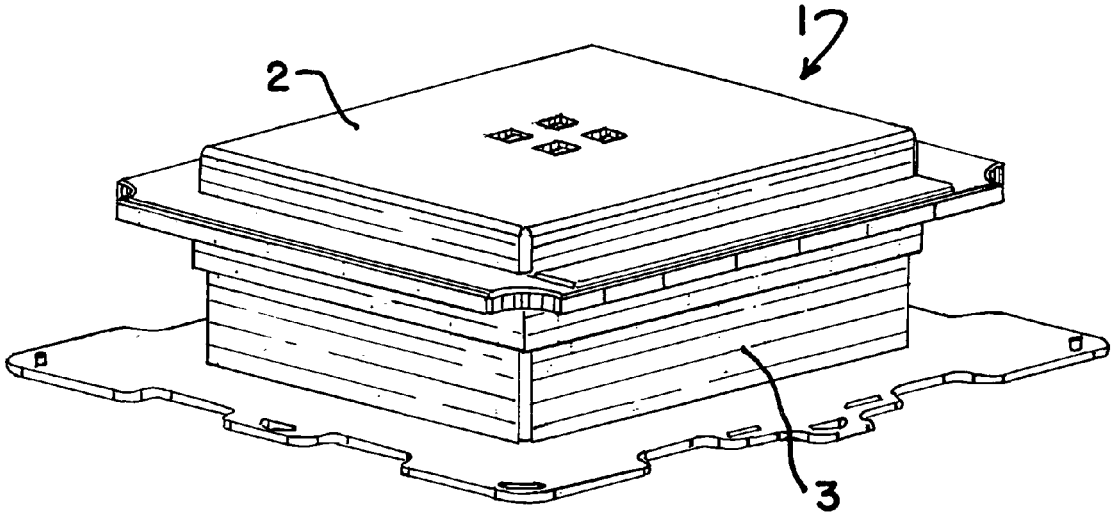
FIG. 1 is a side perspective view of the assembled wall-mounting block of the present invention.
Figure 2:
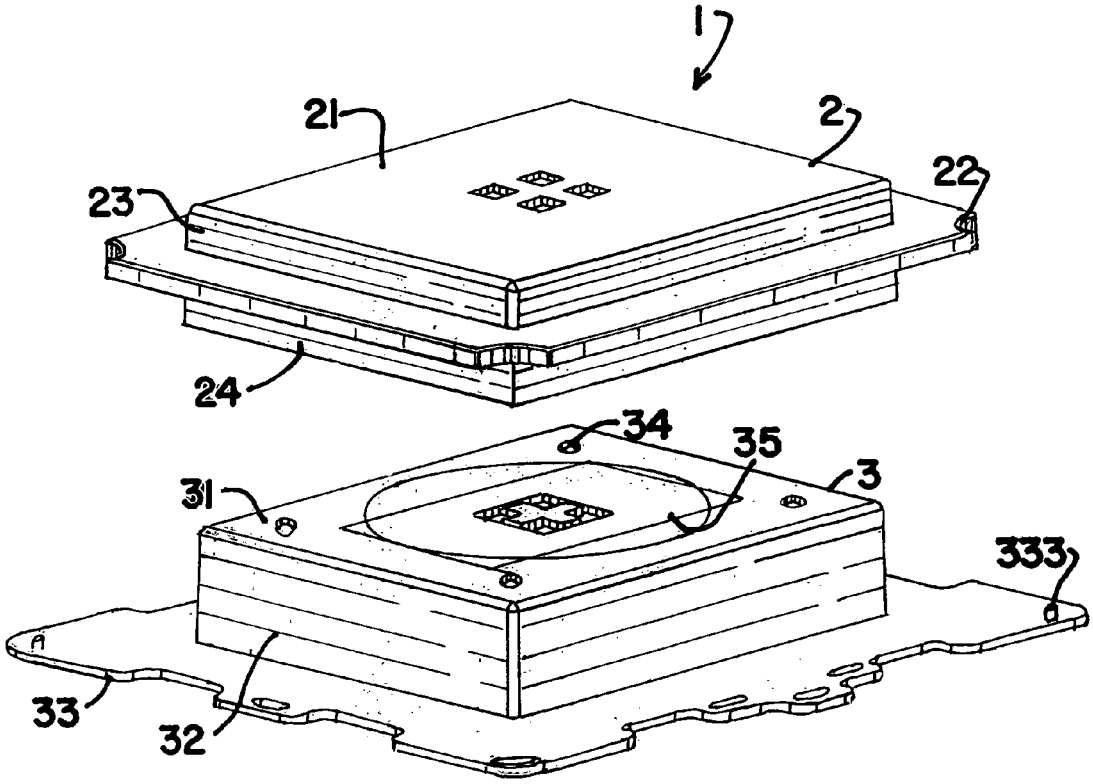
FIG. 2 is a side perspective view of the wall-mounting block of the present invention, with the two sections separate.
Figure 3:
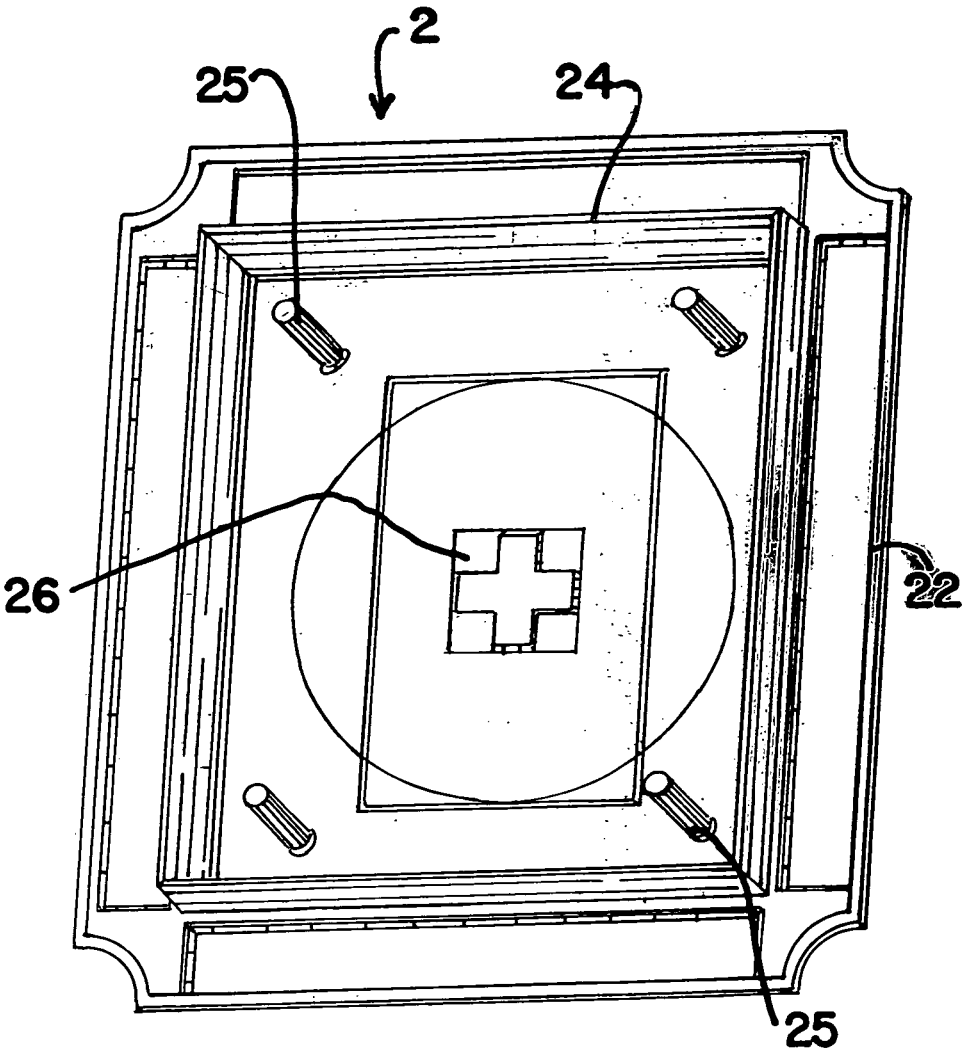
FIG. 3 is a bottom perspective view of the upper section of the wall-mounting block of the present invention.
Figure 4:
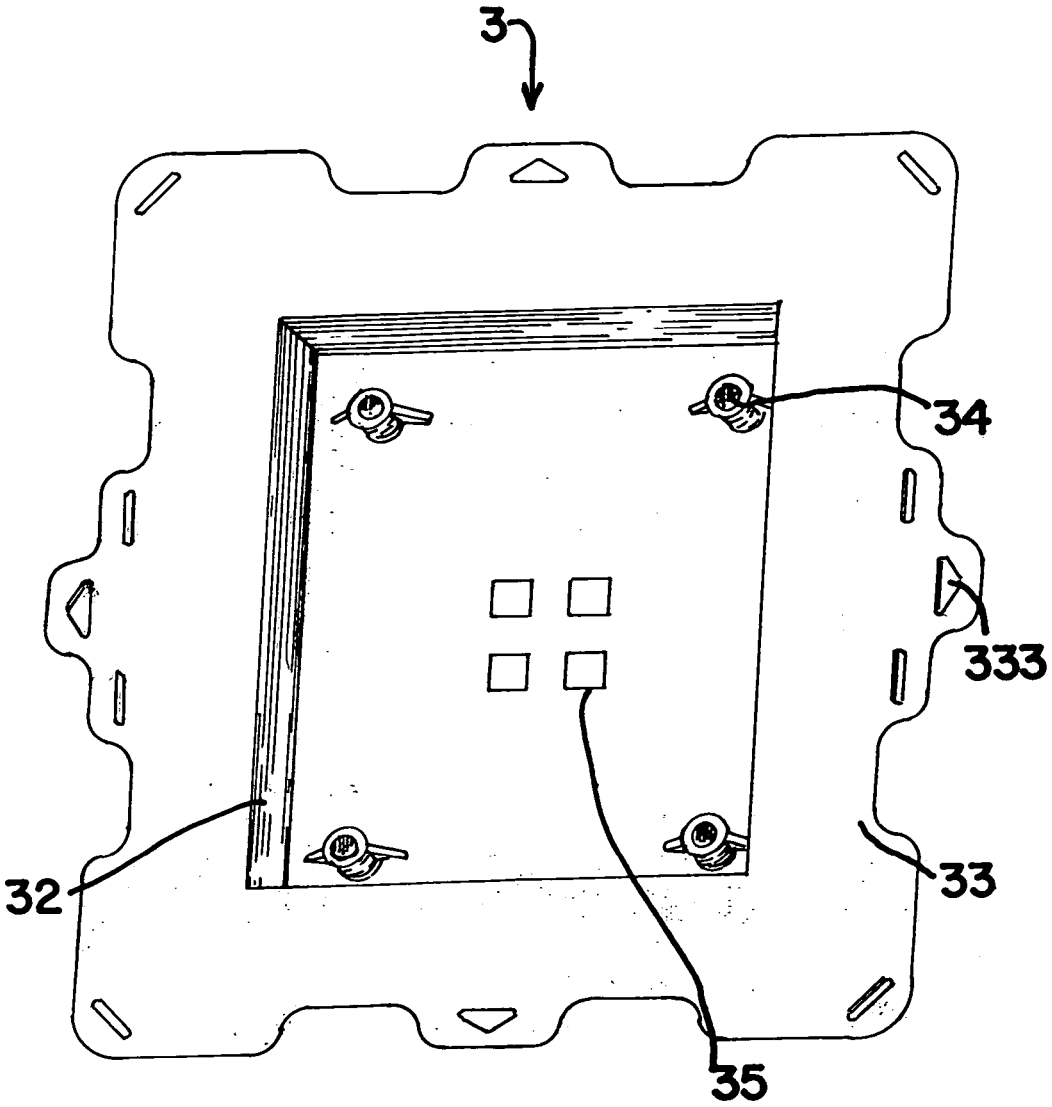
FIG. 4 is a bottom perspective view of the lower section of the wall-mounting block of the present invention.

In the FIG. 1 depiction, the wall-mounting block 1 is as it would be configured after being attached to the wall substrate (not shown) and after the upper or holding section 2 is locked down over the siding (not shown), which itself is permanently connected to the wall substrate. It should be noted that the mounting flanges 33, which are part of base or first section 3, are meant to slide under the siding (not shown) as part of the overall installation. It should be understood that pieces of the siding must be removed to accommodate mounting block 1 which is meant to fit over an aperture (not shown) in the wall substrate to accommodate the fixture.

The wall substrate is usually standard building sheathing, that can be constituted by a number of different materials. The siding is likewise standard material, usually, wood, vinyl, or aluminum. However, other materials can be used for the sheathing or siding with the present invention.

The lower or base section 3 has an interface surface 31, which is used to interface with mounting surface 21 of upper or holding piece 2, and to help hold the fixture (not shown). Normally fixtures have parts passing through an aperture in the wall substrate . The entire wall-mounting block 1 is meant to fit around the exterior of an aperture in both the siding and the substrate. Accordingly, both mounting surface 21 and interface surface 31, must accommodate apertures. Interface surface 31 can be provided with a number of different holes or drilling arrangements 35 to facilitate easy passage therethrough of the fixture parts (not shown). Surface 31 is supported by support structure 32, constituted by four sidewalls extending around the base section 3 to form a cap-like structure.

In one preferred embodiment, the sidewalls of support structure 32 are of a single height. However, this is not always the case. Rather, the sidewalls can be of a telescoping structure to accommodate different sizes of siding or different requirement of the fixtures (not shown) to be mounted on mounting block 1.

During the installation of the base section 3, mounting flanges 33 are slipped beneath siding pieces (not shown). Any different number of or size of connecting holes 333, or configuration of those holes can be used to accommodate connectors to hold mounting flanges to the substrate. Mounting holes can be configured for a particular type of substrate and a particular type of connector (not shown) to be used. Of particular interest is the fact that mounting flange 33 extends well beyond holding piece 22 of the upper or holding section 2. This arrangement provides a much larger footprint and thus more stable connection to the wall substrate. It also provides flexibility in that part of the mounting flange 33 can be cut or eliminated to help facilitate the instillation of mounting block 1.

Fastening can be done by means of wood screws, nails, brads, staples or adhesives. If the wall substrate is plastic, ultrasonic welding can be used. If the wall substrate is metallic, appropriate means, such as machine screws, can be used for attaching the plastic mounting flange 33 to the metallic skin of the wall substrate. Most likely sheet metal screws, or even rivets would facilitate the mounting. Even glue can be used to hold the mounting flange 33 to the wall substrate.

A major attribute of the present invention is the oversized mounting flange which permits more of the wall substrate to be used to support both mounting block 1 and the accompanying fixture (not shown). Accordingly, a large variety of different fixtures can be supported in a stable mounting arrangement on virtually any type of wall.

It should be understood that the thickness of mounting flange 33 is not limited to any specific value. Rather, this can be made thicker or thinner in the manufacturing process to facilitate connection to a particular type of wall substrate. Also, the other parts of the wall-mounting block 1 can be modified to any size that is appropriate for a particular environment or application. The wall-mounting block 1 is preferably made of plastic using an injection-molding process, but other processes can be used Likewise, any number of different materials can be used, including: nylon, rubber, wood or metal.

A key attribute of the present invention resides in the contiguous support structure (32, 23-24, respectively) of each section 2, 3. These are constituted by the side walls and the upper surfaces of both the lower base section and the upper holding section. The side walls of both sections are contiguous with each other and with the upper surfaces of each section. The side walls of each section are also contiguous with their respective mounting flanges 33 and holding flanges 22. This results in cap-like contiguous structures that are very stable and resist warping. As a result, water migration is severely curtailed due to a lack of openings in the overall structure constituted when the two sections 2, 3 are combined as depicted in FIG. 1.

The rigid side wall structures of the upper holding section 2 are divided into two sections, the upper 23 and the lower 24. These are divided by the holding flange 22 which extends over the siding (not shown), holding it in place. The side walls 23, 24 fit closely over the side walls 32 of the lower or base section 3. Because both cap-like structures are relatively rigid, a close fit is easily effected. The close fit and contiguous nature of both sections 2, 3 provide for a substantial resistance to the migration of water or other fluids. Also, because the side walls of the base section 3 are contiguous with the mounting flange 33, opportunity for the migration of moisture is further limited Likewise, the fact that the holding flanges 22 are contiguous with the side walls 23, 24 of the holding section 2 also eliminated another possible rout of moisture migration.

The two upper surfaces, interface surface 31 and mounting surface 21 of the two sections 2, 3, respectively are constituted by essentially solid structures, contiguous with their respective side walls (32, 23-24). This arrangement provides not only proof against migration of moisture but also a very stable structure to support the fixture to be placed on the mounting block 1. Because of the stability of the mounting block, efficient structural support exists to allow the use of pre drilled holes and apertures, such as the drilling pattern 26 in FIG. 3. Both of the upper surfaces 21, 31 have sufficient structural stability to support drilling patterns.

Likewise, either of the upper surfaces 21, 31 can independently support the fixture to be arranged on the mounting block 1. For the interface surface 31 to support the fixture (not shown). All that need be done is to form an aperture in mounting surface 21 sufficiently large to accommodate the fixture. This leads to a much higher level of versatility when dealing with unusual fixture sizes and shapes, or other mounting requirements.

This versatility is further ensured by the connector arrangements formed in each of the two upper surfaces 21, 31 of the respective sections 2, 3.

A great deal of the installation flexibility enjoyed by the present invention resides in the nature of its connecting arrangement. In one embodiment of the present invention the upper holding section 2 has four connecting prongs 25 oriented downward from mounting surface 21. These are preferably formed entirely as part of holding section 2, and are configured with rough or ribbed surfaces so as to effect a friction fit with connector recesses 34 on base section 3.

Base section 3 includes four complementary recesses 34 positioned to interface with the connecting prongs 25 of holding section 2. The interior of these recesses are contoured so as to interact with the exterior of connecting prongs 25 in order to create a friction fit connection. The friction fit permits a secure connection between the two pieces 2, 3 over a wide range of distances from each other. Because the connector recesses 34 are open ended, the connector prongs 25 can pass entirely therethrough when accommodating thinner sidings. Further, because the friction connection operates with very little length of connector prongs 25 within the connector recesses 34 substantial thicknesses of siding can also be accommodated. This increases the range of thicknesses of siding that can be accommodating by the mounting block 1 of the present invention.

Preferably, there are four sets of connectors (25, 34) located at each corner of mounting block 1. Because easily adjustable friction connectors are involved, continuous (also known as infinite) adjustment over most of the entire length of the connectors is easily facilitated. Further, adjustment takes place over the entire periphery of the mounting block 1 in a uniform manner. There is no rotational movement necessary as is common in many conventional mounting block systems.

The smooth, uniform adjustment of the two sections (2, 3) of the mounting block 1 is also facilitated by the cap-like structures that closely fit over each other. Not only is the resulting structure easy to install (even in unskilled hands), it is also very robust and resistant to entry of moisture in the usual places.

If special thicknesses must be accommodated it is relatively simple to add extensions to connecting prongs 25. This can be done in the molding process by welding plastic extensions or any other technique that would serve to extend the connecting prongs within the known plastic molding technology. Overly-long connecting prongs 25 can be trimmed to a desired length. However, too much trimming can lead to problems.

Figure 5:
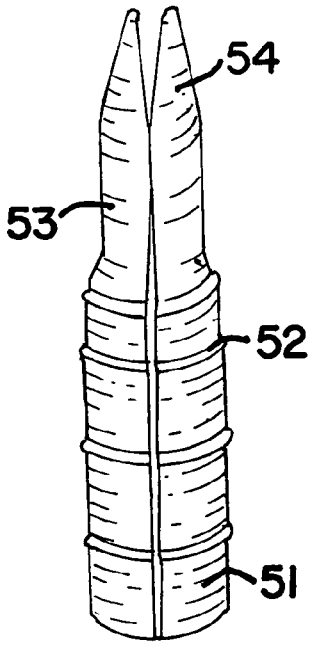
FIG. 5 is a side perspective view of one part of a connecting mechanism used with the present invention.
Figure 6:
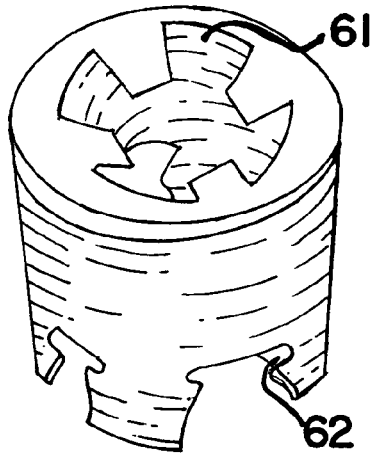
FIG. 6 is a top perspective view of a second part of a connecting mechanism used with the present invention.
Figure 7:
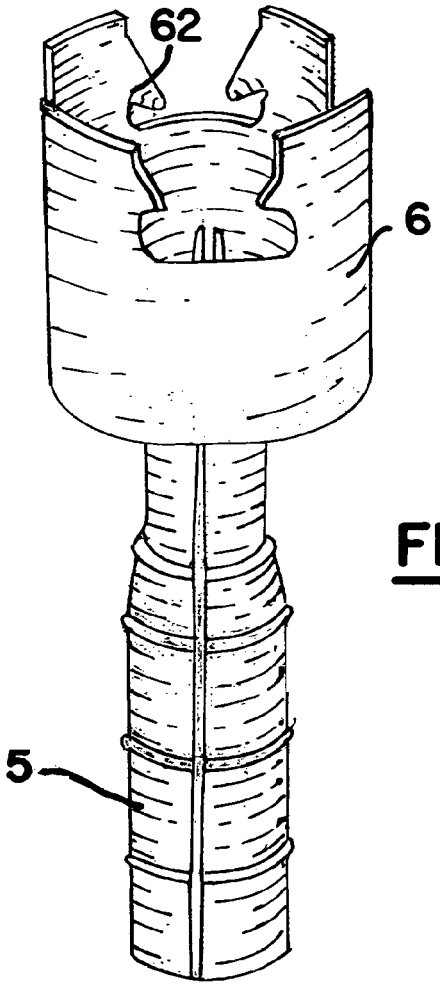
FIG. 7 is a side perspective view of the two parts of the connecting mechanism as they operate together when used with the present invention.

One alternative is found in the auxiliary connector arrangement depicted in FIGS. 5-7. These embodiments are constituted by elongated extensions 5 and receivers 6. Elongated extensions 5 can be inserted on the end of connecting prongs 25. Receivers 6 can be placed within connector recesses 34. Both extension 5 and receivers 6 are preferably made of any spring like material such as brass, steel, or aluminum. However, they can also be made of any semi-rigid plastic material such as nylon or thermal plastic. They are best applied to the present invention simply by placing extensions 5 on connecting prongs 25 and inserting receivers 6 into connecting recesses 34.

The auxiliary connector arrangement of FIGS. 5-7 is not necessary for the practice of other preferred embodiments of the present invention. Rather, the auxiliary connector arrangement can be added for special circumstances imposed by environment or size requirements. This inventive connector arrangement can be added at the job-site to accommodate various unforeseen conditions or can be added at the factory when the mounting block 1 is built to a particular set of specifications. Preferably, parts 5, 6 of the auxiliary connector arrangements are made to thicknesses so that are easily formed.

One embodiment of the auxiliary connector arrangement includes the elongated extension 5 in FIG. 5. This extension is hollow and formed in three sections identified by physical configuration. The first part is preferably a hollow cylindrical base 51, having ribs 52 to facilitate connection to other pieces. The base 51 can fit over a cylindrical extension (such as 25). Because of the ribbed construction, the cylindrical base 51 can also fit into a recess and be supported thereby. The next section is a smooth cylindrical part 53. Extending from that is a conical part 54. The entire extension 5 is split (either a single or double split) to facilitate adjustability and a spring-like action upon installation.

The extension 5 operates in conjunction with receiver 6, having a cylindrical body, as depicted in FIG. 6. The receiver 6 is constituted by upper spring protrusions 61 which are designed to be deflected by parts of the extension 5. Because a spring-like material is used for the receiver, the upper spring protrusions tightly grip the structure that has deformed them, securely holding it. Receiver 6 also includes lower inner extensions 62 which can serve a variety of different purposes. For example, they can be bent inward to grip a cylindrical body around which the cylindrical receiver is mounted. They can also be used to stop travel of a mating connecting extension such as that of FIG. 5. Further, they can be turned outward in case the receiver 6 is being received into a larger recess. The spring-like material constituting receiver 6 facilitates any of these operations easily.

FIG. 7 depicts the inter-action of extension 5 and receiver 6 when in use. This connecting arrangement can be substituted for that in previous embodiments of the previous embodiments of the present invention, or added thereto. The key attribute of the connecting arrangement is the additional flexibility and size accommodation provided to the other embodiments of the present invention.

While the examples depicted in the drawings have been square in shape, the present invention is not limited to this configuration. Rather, the shape of the mounting block 1 can be circular, half-circular, trapezoidal, or even triangular. Further, rather than providing a mounting surface for a fixture, the entire mounting frame can encompass the fixture. An example would be gable vents and dryer exhaust vents. The use of the present invention in such an embodiment would greatly simplify the mounting of gable vents, which can be somewhat problematic using conventional methods. A wide range of fixtures can be accommodated with the present invention. Accordingly, the present invention can be used with plumbing fixtures, such as wall-mounted valves or faucets, as well as lights, vents, decorative fixtures, and the like.

While a number of the embodiments of the present invention have been made by way of example, the present invention is not limited thereby. Rather, the present invention should be construed to include any and all modifications, variations, permutations, adaptations, derivations and embodiments that would occur to one skilled in this art and comprehending the teachings of the present invention. Accordingly, the present invention should be limited only by the following claims.

I claim:

1. A wall-mounting block in two sections arranged to hold a fixture to a wall having a substrate and siding arranged over the substrate, said wall-mounting block comprising:

a. a base section having at least one integrally formed mounting flange arranged to be positioned against the substrate, and a cap-like support structure including sidewalls extending perpendicularly from said mounting flange to a contiguous integrally formed upper interface surface, said interface surface including a plurality of integrally formed connector recesses; and b. a holding section having integrally formed contiguous sidewalls supporting perpendicularly extending, integrally formed holding flanges and upper support surface to form a cap-like structure arranged to fit over said cap-like support structure of said base section, said upper support surface having downwardly extending connecting prongs corresponding to said plurality of connector recesses.

2. The wall-mounting block of claim 1, wherein said upper support surface constitutes a mounting surface substantially parallel to the substrate, and arranged to receive the fixture.

3. The wall-mounting block of claim 2, wherein said wall-mounting block comprises four connecting prongs corresponding to four connector recesses.

4. The wall-mounting block of claim 2, wherein said upper support surface comprises a drilling pattern.

5. The wall-mounting block of claim 3, wherein said connecting prongs and said connector recesses interact as friction-fit devices.

6. The wall-mounting block of claim 5, wherein said connecting prongs and said connector recesses are arranged at four corners of said mounting block.

7. The wall-mounting block of claim 6, wherein said connecting prongs and said connector recesses effect a uniform connection between said base section and said holding section over a plurality of distances between said base section and said holding section.

8. The wall-mounting block of claim 1, wherein said upper interface surface constitutes a mounting surface essentially parallel to the substrate and arranged to receive the fixture.

9. The wall-mounting block of claim 8, wherein said upper interface surface comprises a drilling pattern.

10. The wall-mounting block of claim 1, wherein said cap-like structure of said holding section fits closely over said cap-like structure of said base section.

11. The wall-mounting block of claim 1, wherein the wall-mounting block is made of material selected from a group consisting of plastic, rubber, metal, nylon, and wood.

12. The wall-mounting block of claim 1, wherein said wall-mounting block is configured to hold the fixture at an aperture in the wall.

* * * * *